US007849618B2

(12) United States Patent
Dicke

(10) Patent No.: US 7,849,618 B2
(45) Date of Patent: Dec. 14, 2010

(54) COLLAPSIBLE SIGN FOR USE IN OR NEAR A ROADWAY

(75) Inventor: Grant D. Dicke, Downers Grove, IL (US)

(73) Assignee: Dicke Tool Company, Downers Grove, IL (US)

( * ) Notice: Subject to any disclaimer, the term of this patent is extended or adjusted under 35 U.S.C. 154(b) by 459 days.

(21) Appl. No.: 12/009,772

(22) Filed: Jan. 22, 2008

(65) Prior Publication Data

US 2009/0183408 A1 Jul. 23, 2009

(51) Int. Cl.

| | |
|---|---|
| ***G09F 15/00*** | (2006.01) |
| ***G09F 7/00*** | (2006.01) |
| ***G09F 17/00*** | (2006.01) |
| ***G09F 15/02*** | (2006.01) |
| ***G08B 13/08*** | (2006.01) |
| ***A47H 1/00*** | (2006.01) |
| ***A47G 5/00*** | (2006.01) |

(52) U.S. Cl. ..... 40/610; 40/603; 40/601; 40/606.11; 40/607.03; 40/604; 40/612; 160/10; 160/85; 160/351

(58) Field of Classification Search ..... 40/610, 40/603, 601, 606.11, 607.03, 604, 612; 160/10, 160/85, 351

See application file for complete search history.

(56) References Cited

U.S. PATENT DOCUMENTS

| | | | | |
|---|---|---|---|---|
| 2,484,096 A | | 10/1949 | Kay | |
| 4,426,800 A | | 1/1984 | Brown | |
| 4,507,887 A | | 4/1985 | Seely | |
| 4,535,825 A | | 8/1985 | Hackney | |
| 4,592,158 A | | 6/1986 | Seely | |
| 4,875,302 A | * | 10/1989 | Noffsinger | 40/610 |
| 4,888,894 A | | 12/1989 | Brown, Jr. | |
| 5,152,091 A | | 10/1992 | Leach | |
| 5,446,984 A | | 9/1995 | Kulp et al. | |
| 5,472,162 A | | 12/1995 | Mason | |
| 6,003,827 A | | 12/1999 | Kulp et al. | |

OTHER PUBLICATIONS

*Manual on Uniform Traffic Control Devices Part 7*, U.S. Department of Transportation, Federal Highway Administration, 2003 Edition, (undated, but admittedly prior art) (21 pp.).

* cited by examiner

*Primary Examiner*—Lesley Morris
*Assistant Examiner*—Syed A Islam
(74) *Attorney, Agent, or Firm*—Olson & Cepuritis, Ltd.

(57) ABSTRACT

A sign system is disclosed in which a flexible sign panel is supported by light weight frame numbers such as fiberglass ribs joined together with a pivot connection. A sign panel of flexible material has a center section disposed between a pair of opposed sign panel portions. The center portion of the sign panel engages a cross member with the sign panel portions being folded over on either side of an upright support member. Free ends of the sign panel member are secured with a stretchable elastic cord, ribbon or the like, to a mounting member having a socket for receiving one end of the vertical support member. By engaging the mounting member and stretching the elastic cords, the mounting member is disposed over one end of the vertical support and one released, engages the vertical support holding the sign panel portions in a display position.

25 Claims, 13 Drawing Sheets

COLLAPSIBLE SIGN FOR USE IN OR NEAR A ROADWAY

FIELD OF THE INVENTION

The present invention relates to collapsible warning signs which can be used either in or near a roadway to advise motorists as to caution conditions.

DESCRIPTION OF THE RELATED ART

Over the years, different types of sign systems have been proposed for warning motorists of unusual caution conditions. Such conditions typically arise infrequently or only during certain parts of a work day. Accordingly, it is preferred that the sign systems be relatively light weight and subject to easy storage configurations. For example, roadway signs have been proposed utilizing flexible sign panels supported by framework which can be quickly and easily separated from the sign panel and collapsed for storage in a vehicle, for example. The framework for these types of sign systems originally included rigid metallic frame members but, increasingly, these are being replaced by frame members of epoxy rib construction. Such sign stands are typically employed on the side of the roadway or on the roadway edge so as to avoid unintentional contact with oncoming vehicles. If the roadway is reduced in size by traffic delineators such as cones or barricades, design systems may be employed adjacent to such delineator devices.

It is generally desirable that the sign systems be self supporting, yet light weight and portable. Initially, the framework was supported by a system of collapsible support legs which, when folded out, resemble a tripod or similar structure for engaging the ground. Recently, monolithic slabs have been proposed for supporting an upright framework member. The slabs may be made of crumb rubber or the like pliable, resilient material for example. The use of these types of sign bases has been noted, in some applications, to improve crash worthiness of the sign system.

Heretofore, temporary roadway warning signs have been employed largely by construction and repair crews that are deployed on or near a roadway surface. In the past, unusual, temporary caution conditions not associated with a construction event, such as school cross-walks, have been protected by human operators holding a warning sign. Even in construction areas, human operators are sometimes employed to manually present a caution sign to oncoming motorists. Increasingly, usage of in-street signing has been proposed for special events such as school crosswalks that are in use for only a small portion of the day. The Federal government and various State and local organizations have proposed their own Manual on Uniform Traffic Control Devices (MUTCD). For example, one such manual is published by the Federal Highway Administration of the U.S. Department of Transportation. States and local governmental bodies have been inspired to either adopt or produce their own manual, drawing inspiration from the work done by the Federal government. Accordingly, attention is now being given to enhancing pedestrian crosswalks using improved in-street signage. Uniform in-street pedestrian crossing signs or reduced sized in-street School Advance Warning signs have been proposed in the Federal Highway Administration MUTCD Section 7B09.

Even if similar signs are employed remote from a roadway surface, advantages can be obtained from the use of in-street signage.

SUMMARY OF THE INVENTION

The present invention provides a novel and improved sign system. A first embodiment of a sign system, according to the present invention includes a flexible sign panel having a middle section and opposed free ends, along with a frame including first and second frame members pivotally joined together, with each frame member having opposed free ends. A mounting member defines a socket for receiving a first end of the first frame member, and at least one biasing tether connects the mounting member to at least one free end of the sign panel. The support members, the sign panel, the mounting member and the biasing tether cooperate such that, with the second support member engaging the middle section of the sign panel, the free ends of the sign panel are supported adjacent the first end of the first support member, and the second support member and the middle section of the sign panel are supported by the first support member at a point spaced from the first end of the first support member.

The biasing tether may comprise a pair of bias cords having opposed ends extending from the free end of sign panel, with a central portion of the cord engaging the mounting member. Alternatively, the biasing tether could comprise a web of elastic material engaging a center portion of the sign panel free end.

Preferably, the middle section of the sign panel is supported by the second support member which is located at approximately midway between ends of the sign panel, with opposed sign panel portions generally coextensive with one another, so that the free ends of the sign panel are positioned adjacent one another. Also, stiffeners are provided at the free ends of the sign panel.

In another embodiment, a sign system includes a flexible sign panel having a middle section and opposed free ends. A frame includes first and second frame members pivotally joined together, each frame member having opposed free ends, and a mounting member defining a socket receives a first end of the first frame member. At least one biasing tether connects the mounting member to at least one free end of the sign panel. The support members, the sign panel, the mounting member and the biasing tether cooperate such that, with the second support member engaging the middle section of the sign panel, the free ends of the sign panel are supported adjacent the first end of the first support member, and the second support member and the middle section of the sign panel are supported by the first support member at a point spaced from the first end of the first support member. Also included is a support base engaging the second end of the first support member, to engage the second end of the first support member, holding it in an upright position.

In another embodiment, a sign system includes a flexible sign panel having a middle section and opposed free ends, with stiffeners at the free ends and a frame including first and second frame members pivotally joined together, with each frame member having opposed free ends. The middle section of the sign panel is supported by the second support member and located at approximately midway between the ends of the sign panel, with opposed sign panel portions generally coextensive with one another, and with the free ends of the sign panel positioned adjacent one another. A mounting member defining a socket receives a first end of the first frame member, and at least one biasing tether connects the mounting member to at least one free end of the sign panel. The support members, the sign panel, the mounting member and the biasing tether cooperate such that, with the second support member engaging the middle section of the sign panel, the free ends of the sign panel are supported adjacent the first end of the first support member, and the second support member and the middle section of the sign panel are supported by the first support member at a point spaced from the first end of the first support member.

In a further embodiment, a sign system includes a flexible sign panel having a middle section and opposed free ends, along with a frame including upright and cross frame members pivotally joined together, each frame member having opposed free ends and at least one engagement member on the upright support member. At least one biasing tether connects the at least one engagement member to the sign panel. The support members, the sign panel, the at least one engagement member and the biasing tether cooperate such that, with the second support member engaging the middle section of the sign panel, the free ends of the sign panel are supported adjacent the second end of the first support member, and the second support member and the middle section of the sign panel are supported by the second support member at a point spaced from the first end of the first support member.

In another embodiment, a sign panel kit includes a flexible sign panel having a middle section and opposed free ends, a frame including first and second frame members pivotally joined together, each frame member having opposed free ends and a mounting member defining a socket for receiving a first end of the first frame member. At least one biasing tether connects the mounting member to at least one free end of the sign panel. The support members, the sign panel, the mounting member and the biasing tether cooperating such that, with the second support member engaging the middle section of the sign panel, the free ends of the sign panel are supported adjacent the first end of the first support member, and the second support member and the middle section of the sign panel are supported by the first support member at a point spaced from the first end of the first support member. Also included is a container for carrying the sign panel, mounting member, tether and base.

DESCRIPTION OF PREFERRED EMBODIMENTS

Figure 1:
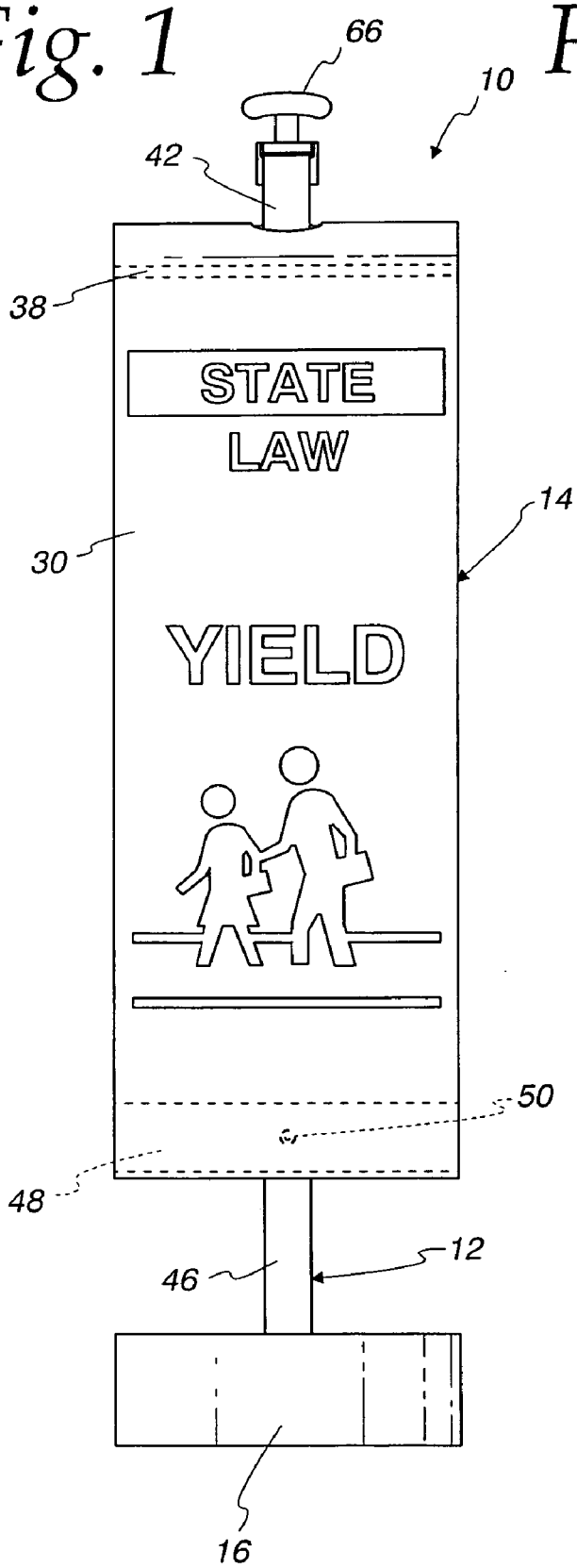
FIG. 1 is a front elevational view of a sign system illustrating the present invention.

The invention disclosed herein is, of course, susceptible of embodiment of many different forms. Shown in the drawings and described herein below in detail are the preferred embodiments of the invention. It is to be understood, however, that the present disclosure is an exemplification of principles of the invention and does not limit the invention to the illustrated embodiments.

For ease of description, sign systems embodying the present invention are described herein below in their usual assembled position as shown in the accompanying drawings in terms such as front, rear, upper, lower, horizontal, longitudinal, etc., may be used herein with reference to this usual position. However, sign systems may be manufactured, transported, sold and or used in orientations other than that described and shown herein.

Referring now to the drawings, and initially to FIGS. 1-12, a first embodiment of a sign system according to principals of the present invention is generally indicated at 10. Included is a framework generally indicated at 12 (best seen in FIGS. 2 and 4) and a flexible web generally indicated at 14 (best seen in FIG. 3). Also included is a base schematically illustrated at 16.

Figure 3:
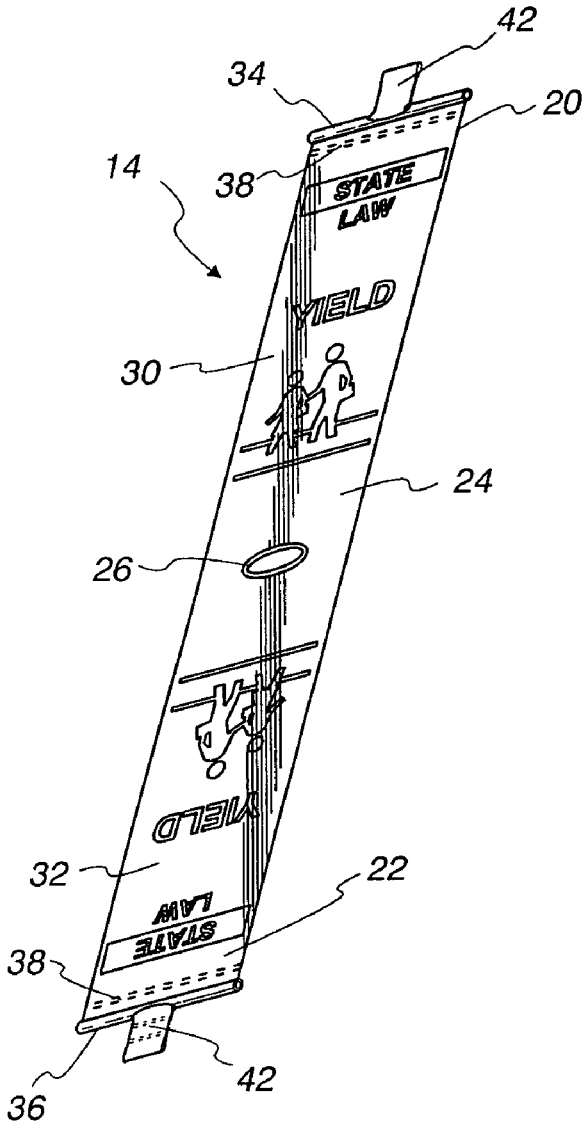
FIG. 3 is a perspective schematic view of the sign panel component thereof.

Referring to FIG. 3, flexible web 14 has opposed free ends 20, 22 and a mid-section 24 preferably located midway between the free ends. An opening 26 is formed in mid-section 24 and is generally preferred so as to facilitate assembly of the sign system. In the preferred embodiment, opening 26 is located at a halfway position between ends 20, 22 and thus divides the flexible web into two panels 30, 32. In the preferred embodiment, stiffeners 34, 36 are located at free ends 20, 22 as indicated for example in FIG. 10, stiffeners 34, 36 preferably comprise a cylindrical dowels about which ends of flexible web 14 are wrapped and secured with stitching 38. In the preferred embodiment, central portions of dowels 34, 36 are exposed so as to facilitate wrapping tethers 42 about the dowels. As will be seen, tethers 42 serve as biased members and are preferably made of elastic material.

Figure 2:
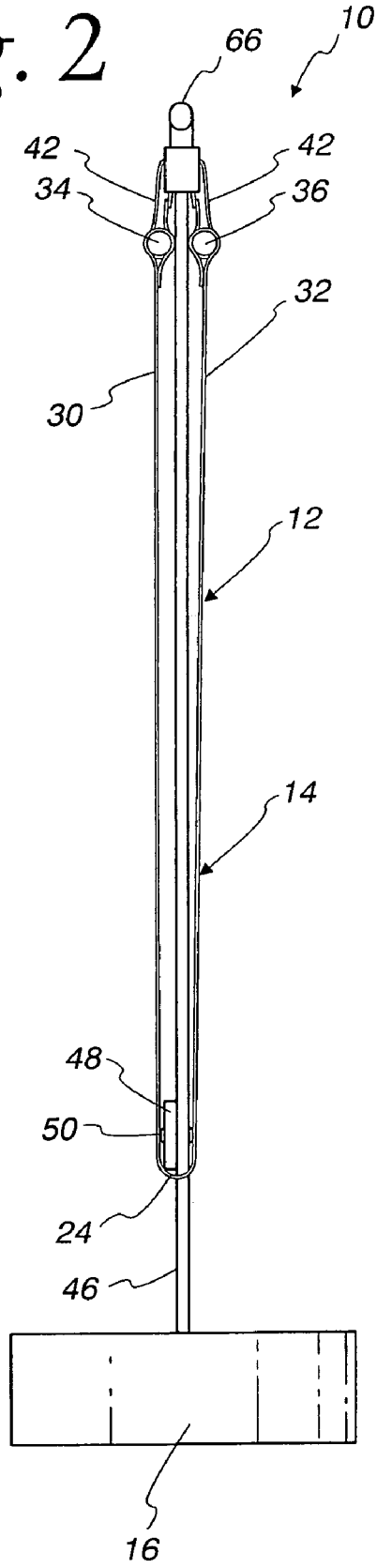
FIG. 2 is a side elevational view thereof.
Figure 4:
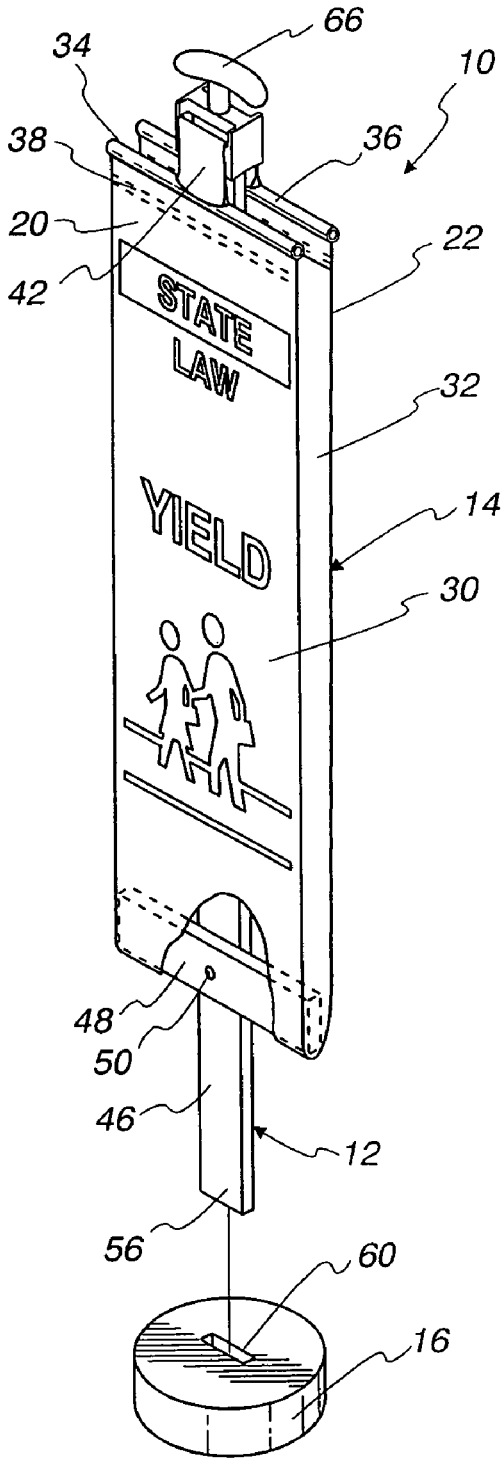
FIG. 4 is an exploded perspective view of the sign system.
Figure 11:
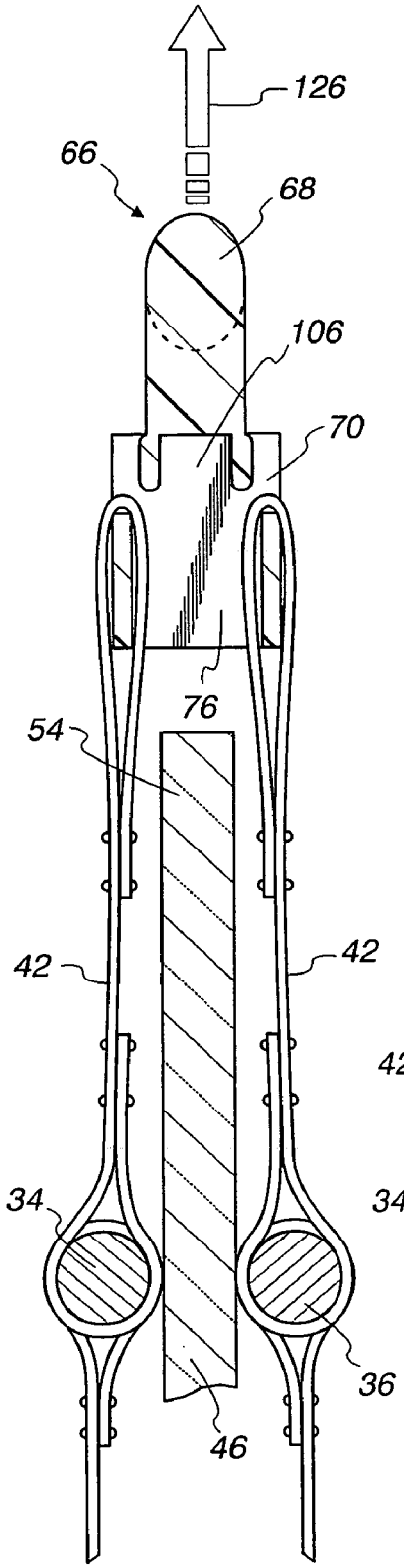
Figure 13:
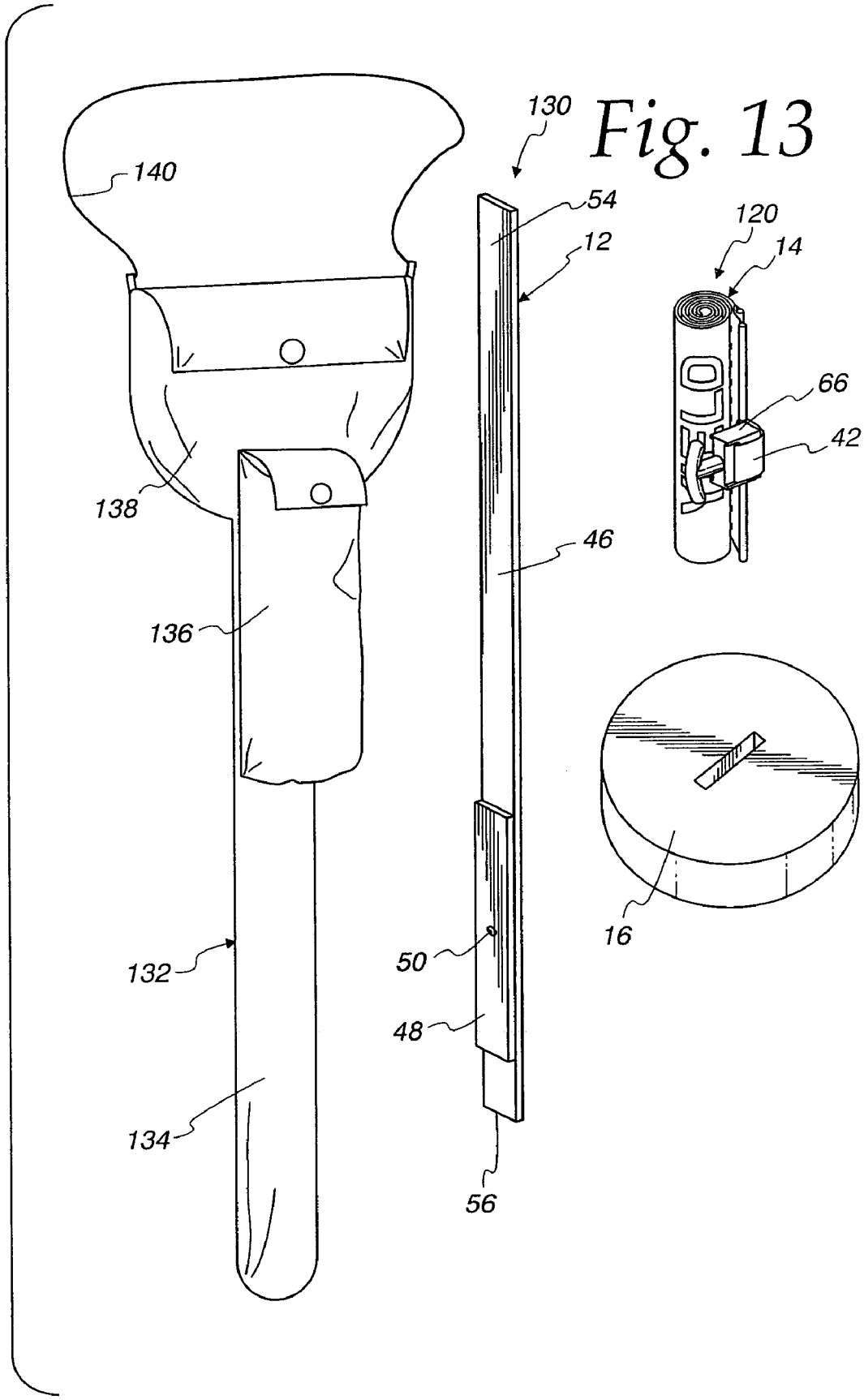
FIG. 13 is a perspective view of kit components for a sign panel system.

Referring now to FIGS. 2 and 4, framework 12 includes an upright number 46, and a cross member 48 joined together by a pivot pin 50. Referring additionally to FIG. 11, upright member 46 has an upper or first free end 54 and a second or lower free end 56 shown for example in FIG. 4. As shown in the drawings, upright and cross members 46, 48 are elongated and have generally rectangular cross-sections. In a preferred embodiment, upright and cross members 46, 48 are preferably made of conventional epoxy rib material and thus are flexible so as to prolong their service light upon incidental contact with an outside source. Pivot pin 50 preferably comprises a hollow rivet, but could also comprise a screw fastener or a solid rivet, the ends of which are headed over, for example. Referring again to FIG. 4, support base 16 is provided with a central aperture 60 for receiving the lower end 56 of upright 46, as indicated in FIGS. 1 and 2, for example. As indicated in FIG. 13, cross member 48 is pivotable so as to become, lined with upright 46 for a compact storage position of minimal size. By simply rotating cross member 48 to the position indicated for example in FIG. 4, framework 12 is placed in an operational mode, ready for assembly of the sign stand.

Figure 8:
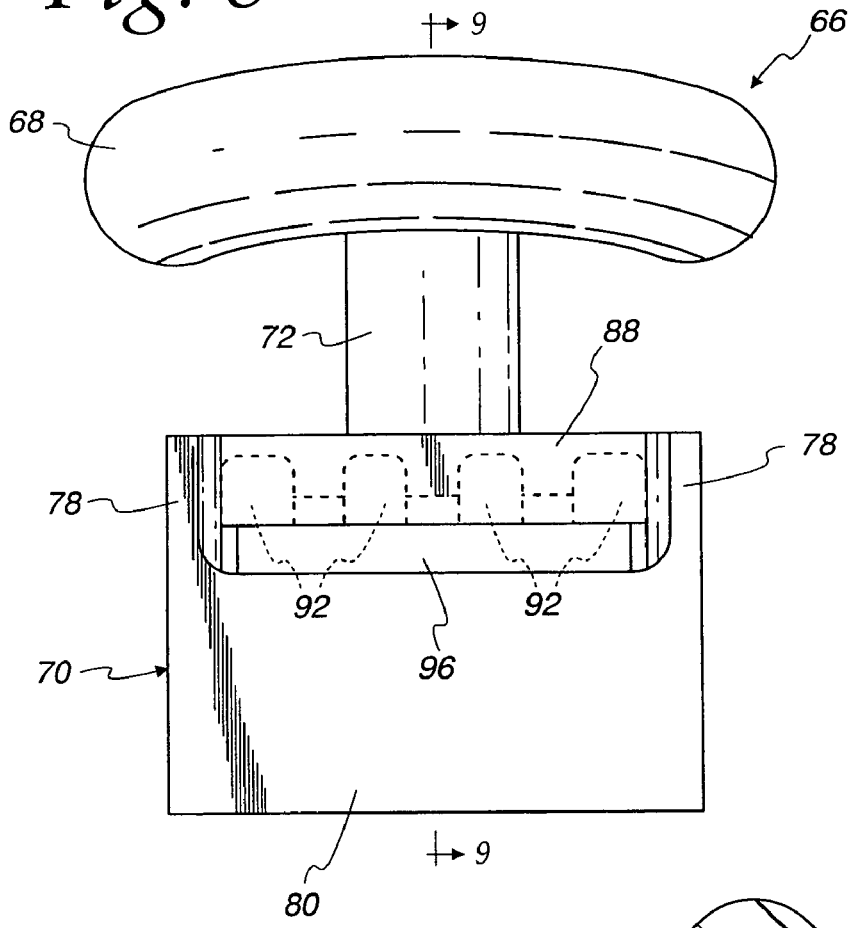
FIG. 8 is a front elevational view thereof.
Figure 9:
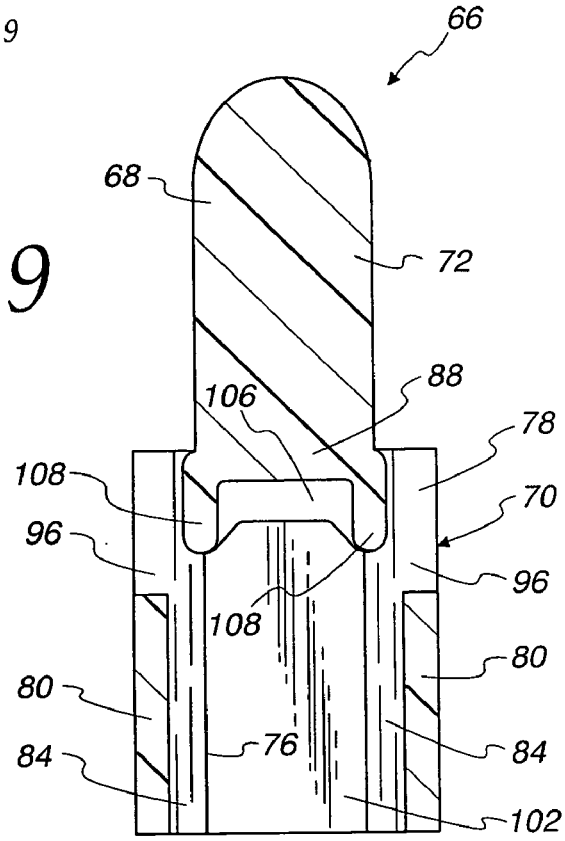
FIG. 9 is a cross-sectional view taken along the line 9-9 of FIG. 8.

As shown for example in FIGS. 1, 2 and 4, a mounting member 66 is located at the top of the sign stand assembly. Referring now to FIGS. 5-9, mounting member 66 is preferably made from a one-piece integral plastic molding. If desired, mounting member 66 could be made from several inter-cooperating parts or could be made from other materials such as wood or metal. Referring for example to FIGS. 8 and 9, mounting member 66 includes a handle 68 joined to a body generally indicated at 70 by a stem 72. Body 70 preferably forms a hollow socket having an interior hollow chamber 76, shown for example in FIG. 5. Included in body 70 are side walls 78 and front walls 80. As can be seen for example in FIGS. 5 and 6, recesses 84 are formed in front walls 80 and extend slightly into side walls 78.

Figure 6:
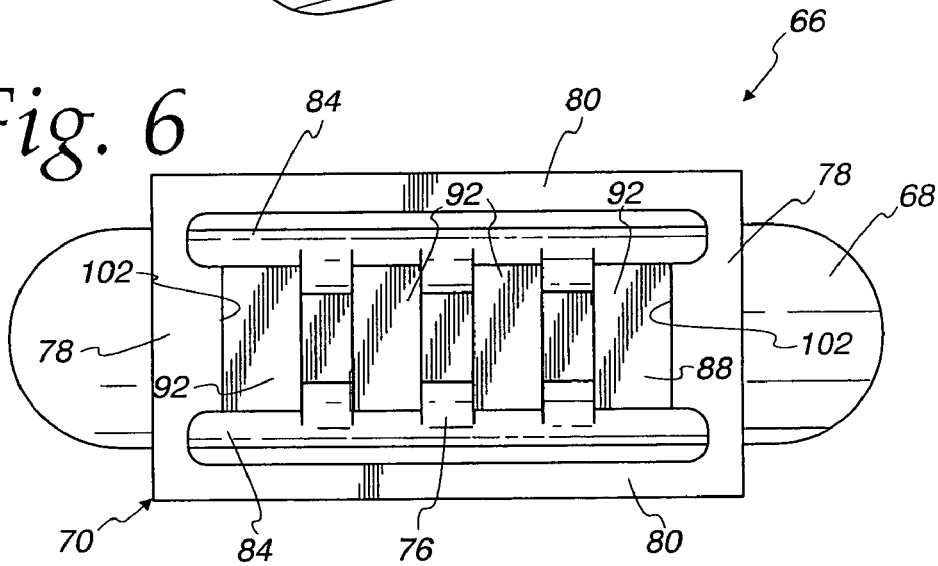
FIG. 6 is a bottom plan view thereof.
Figure 7:
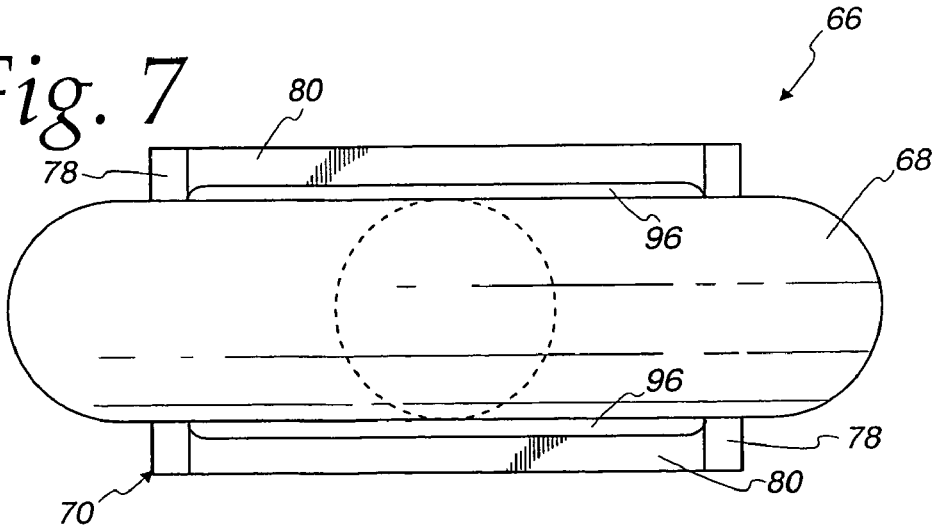
FIG. 7 is a top plan view thereof.

Referring to FIG. 8, body 70 further includes an end wall 88 that extends between side walls 78 and is joined to one end of stem 72. Referring to FIGS. 6 and 8, end wall 88 includes a series of pads 92 which provide a convenient bearing surface for abutting engagement with the upper end 54 of upright member 46, as will be seen with reference to FIGS. 11 and 12.

As shown for example in FIG. 8, front walls 80 do not extend to end wall 88 but rather, are abbreviated so as to form windows 96, exposing the upper ends front walls 80. The windows 96 extend to the hollow interior 76 of body 70. Referring again to FIG. 5, recesses 84 form a raised separator portion 102 separating the channels or recesses 84 from one another. In the preferred embodiment, separator 102 comprises the central portions of side walls 78. As can be seen in FIG. 9, recesses 84 are preferably continuous with windows 96 to allow for easy threading and assembly of the tether members, as will be described below. Referring to FIG. 9, end wall 88 preferably defines a downwardly facing recess 106 defined by side wall 78 and locator walls 108.

Figure 5:
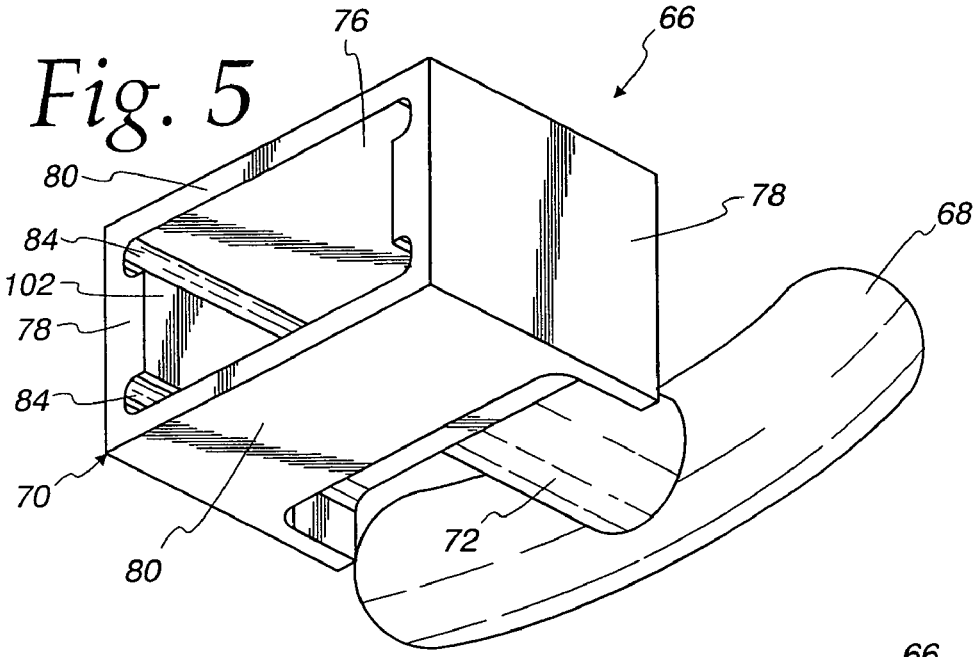
FIG. 5 is a perspective view of a mounting component used in the sign system.
Figure 10:
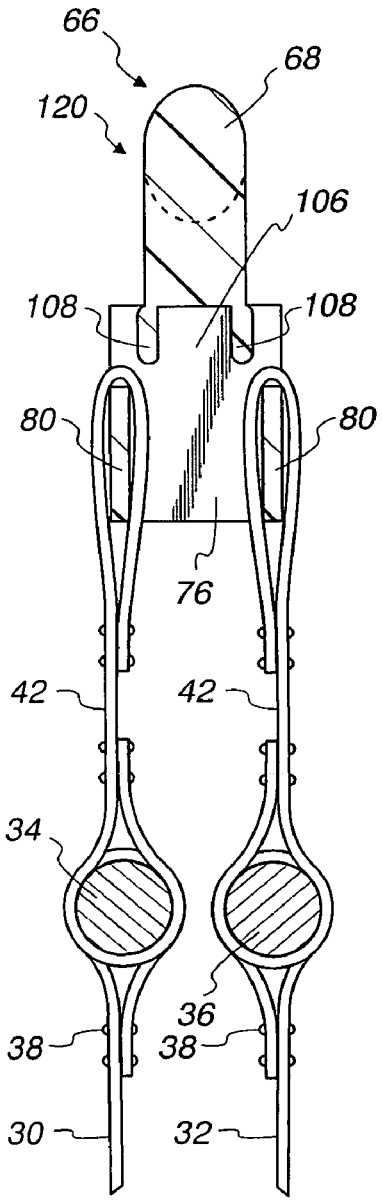
FIGS. 10-12 show a sequence of operations for engaging a sign panel rib with the mounting member.

Referring now to FIGS. 9 and 10, webs 42 are looped over front walls 80 and secured with stitching, as indicated in FIG. 10. The inner portions of the loops surrounding the front walls 80 have edges received in recesses 84 (see FIGS. 5 and 9) so as to space the looped portion of the tethers from the center portion of the hollow interior of body 70. With reference to FIG. 5, recesses 84 gave two parts, a central part which in effect increases the width of the hollow interior of body 70 and the end portions which extend into side walls 78 which hold edges of the tethers 42, captive. Thus, the enlarged width accommodates the thickness of the tethers while the end portions of recesses 84 hold the tether captive so as to press against the inner surface of front wall 80. The tether loops shown in FIGS. 10-12, for example, are exaggerated for drawing purposes, it being generally preferred that the inside portion of the tethered loops are held against or very close to front walls 80, to avoid interference with the upright support member, as will now be described.

Figure 12:
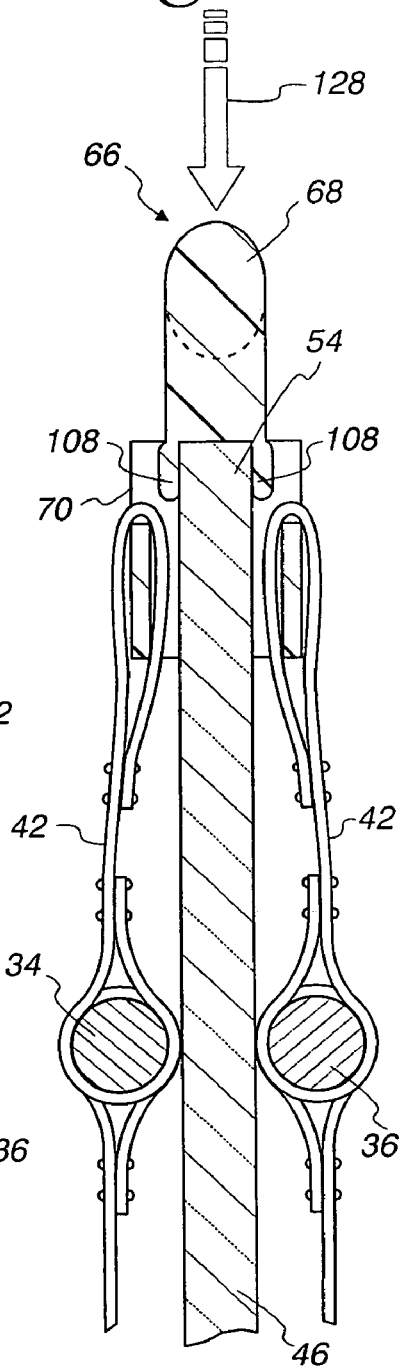

With reference to FIGS. 10-12, and beginning with FIG. 10, the upper portion of a flexible assembly 120 is shown in a relaxed, pre-installation stage. Referring additionally to FIG. 13, flexible assembly 120 include the flexible web 14 (shown for example in FIG. 3) and mounting members 66 joined to the tethers 42 of the flexible web. Assembly of the sign system begins with inserting the lower end 56 of upright 46 through hole 26 of flexible web 14 (FIG. 3). The upright 46 is inserted through opening 26 until cross member 48 contacts mid section 24 of the flexible panel. At this point of assembly, the upper end 54 of upright 46 is located between the upper free ends of the flexible panel. Referring to FIG. 11, the handle portion 68 of mounting member 66 is then pulled in the direction of arrow 126 so as to raise mounting member 66 above the upper free end 54 of upright 46. At this time, the upper end 54 of upright 46 is generally aligned with the hollow interior cavity 76 of body 70 referring to FIG. 12, tension of tethers 42 is relaxed by lowering mounting member 66 in the direction of arrow 128, so as to bring the upper end of upright 46 into the hollow interior of the mounting member 70.

The mounting member is then lowered so as to bring the upper end 54 of upright 46 into recess 106 (see FIGS. 10 and 11), until the upper end of the upright is held captive by locator walls 108. At this point, flexible tethers 42 preferably exert a predetermined downward biased force maintaining engagement of the mounting member and upright, so as to maintain the alignment illustrated for example in FIGS. 2 and 4. Thereafter, the lower end of upright 46 is secured to a support so as to maintain the sign assembly in a generally upright position shown for example in FIG. 4.

If desired, the orientation of the sign system can be quickly and easily attained by providing support base 16 so as to receive and engage upright 46. If desired, the support base may be omitted and a ground socket or hole in a support surface may be provided for this purpose. As a further option, mounting member 66 provides convenient attachment to the side of a traffic standard, vehicle or building wall, for example. Since it is generally preferred that the sign panels 30, 32 have a generally rectangular configuration, cross member 48 is made to have a width sufficient so as to maintain the rectangular configuration at the bottom of the sign panels, and stiffeners are provided at the upper ends of the sign panels, as described.

Referring now to FIG. 13, a sign system kit is generally indicated at 130, and includes, in addition to the sign system components described above, a carrying case 132 having a first compartment 134 for receiving framework 12, a second compartment 136 for receiving flexible assembly 120 and a third compartment 138 for receiving support base 16. In order to contribute to the portability of the sign system, it is generally preferred that the support base 16 be formed of a relatively light-weight material such as crumb rubber, solid rubber which is either machined, case, or molded, wood, fiberglass or other material as may be desirable. With the addition of a carrying strap 140, the kit 130 can be easily transported from one location to another. It is generally preferred that case 132 is made of lightweight flexible material such as a cloth composition, which can be easily folded and stored while the sign system is being displayed.

Figure 14:
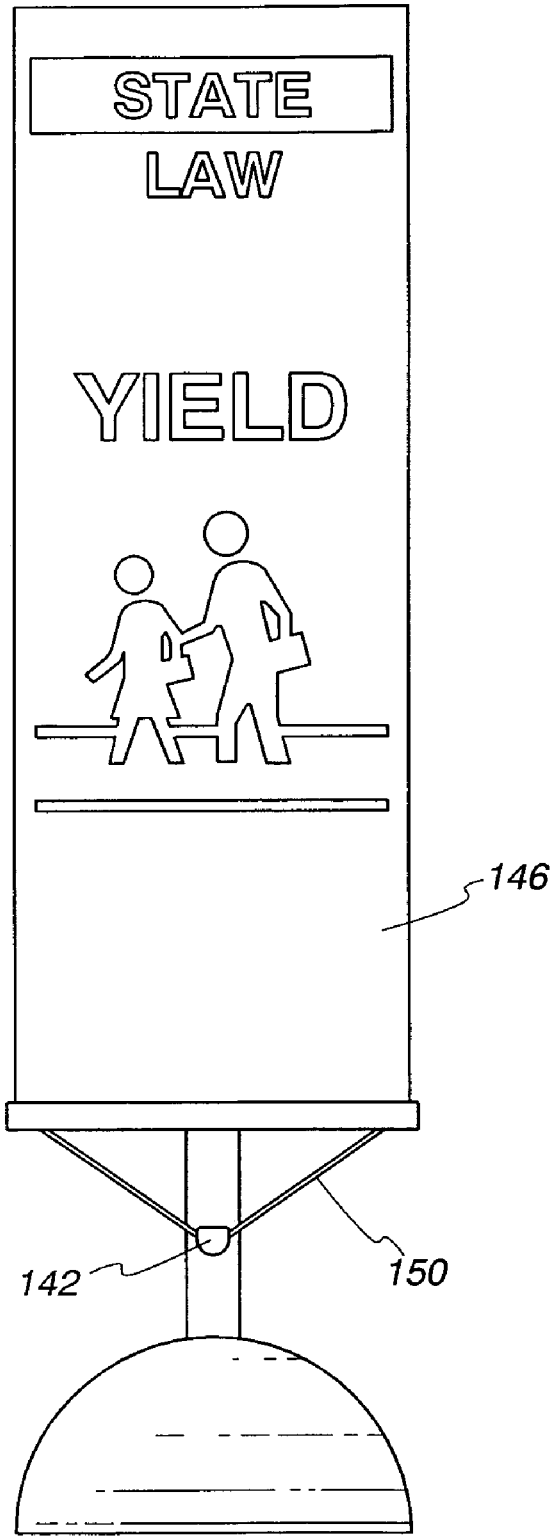
FIG. 14 is a front elevational view of an alternative sign panel system.
Figure 16:
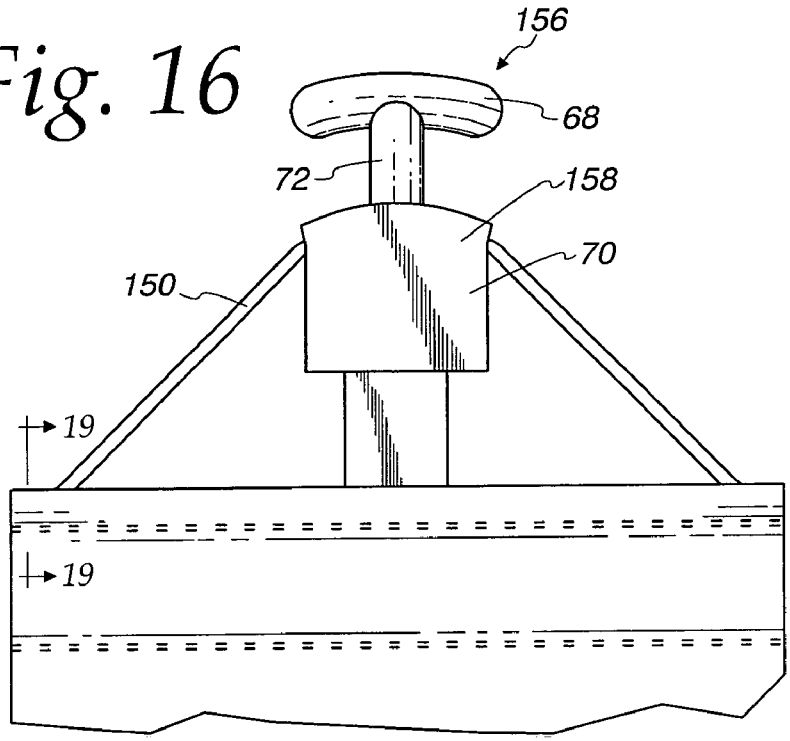
FIG. 16 is a front elevational view of an alternative mounting member arrangement.

Referring now to FIGS. 14 and 16, an alternative arrangement of a sign system is illustrated. The framework 12 is inverted from the first embodiment shown in FIG. 112 and engagement members 142 are provided adjacent the lower end of upright 46. The opposite or upper portion of upright 46 is preferably abbreviated so as to lie entirely within the fold of flexible web 146. If desired, upright 46 can extend upwardly beyond flexible web 146 with the addition of central opening similar to the opening 26 illustrated in FIG. 3. The lower ends of flexible web 146 are preferably provided with stiffeners 34, 36 as described above.

Figure 15:
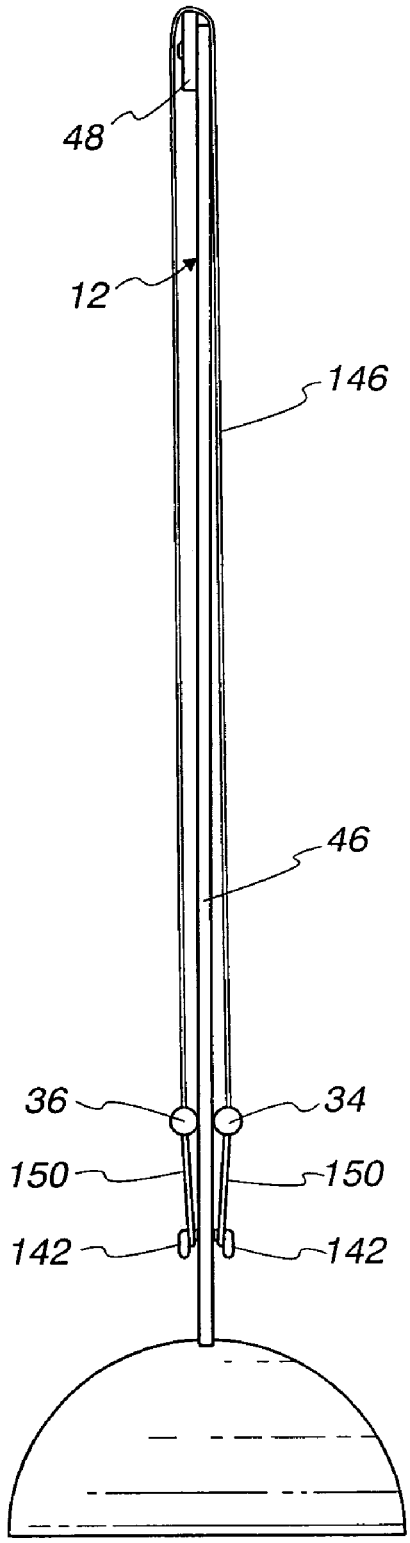
FIG. 15 is a side elevational view thereof.

If desired, the tethers 42 shown for example in FIG. 1 may be employed in an arrangement of FIG. 15, if desired. However, FIGS. 14 and 15 show an alternative arrangement in which a centrally located elastic tether is replaced by a tether cord 150 having end portions secured adjacent the lateral edges of the free ends of flexible web 146. By comparison of FIGS. 1 and 14, it will be noticed that the indicia in FIG. 14 is inverted. If desired, the same flexible web can be provided for assembly according to both FIGS. 1 and 14, with the indicia shown in FIG. 14 printed on the inner surface of the flexible web shown in FIG. 1, for example. Thus, by choosing the relative orientation of framework 12, the proper surfaces of the flexible web can be chosen so as to provide indicia for either arrangement of FIG. 1 or 14.

Figure 17:
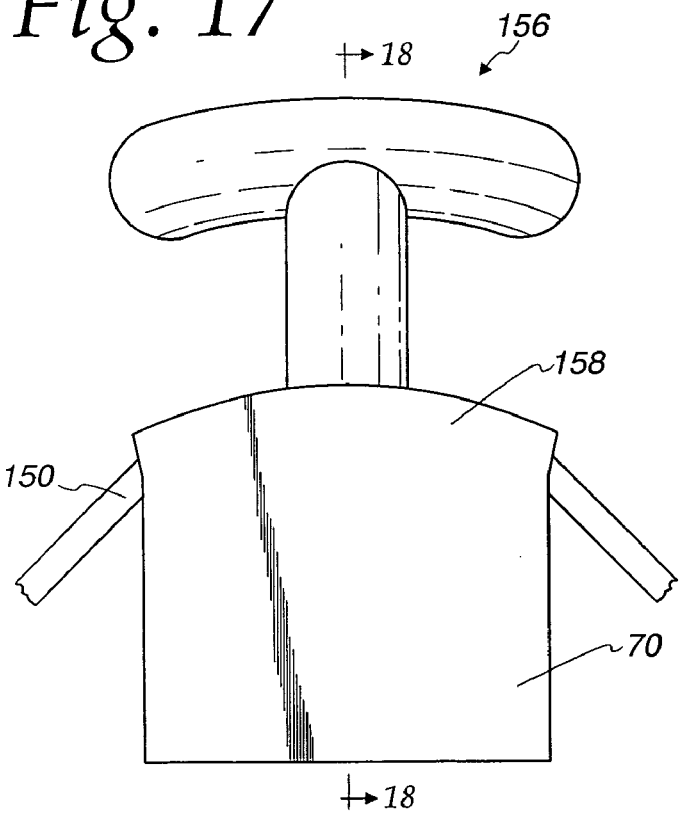
FIG. 17 shows a portion of FIG. 16, taken on an enlarged scale.
Figure 18:
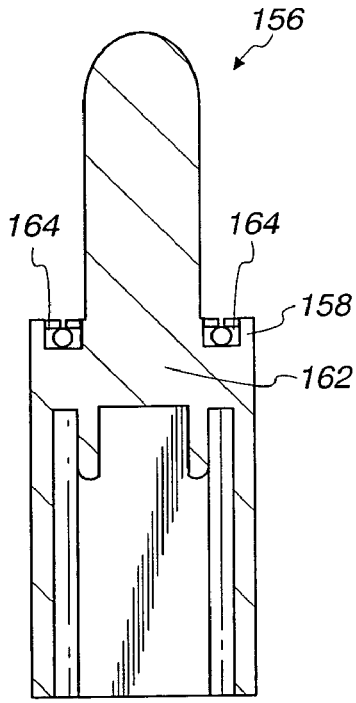
FIG. 18 is a cross-sectional view taken along the line 18-18 of FIG. 17.

If tether cord 150 is to be used in place of the central tether 42, modifications to the mounting member 66 shown in FIGS. 1-12, is generally preferred. Referring to FIGS. 16-18, a mounting member 156 is generally identical to the mounting member 66 described above, except that body 70 is provided with an optional upper structure 158 shown in FIGS. 16-18 and 21. With reference to FIG. 18, end wall 162 is provided with a pair of recesses 164, for receiving respective tether cords 150.

Figure 21:
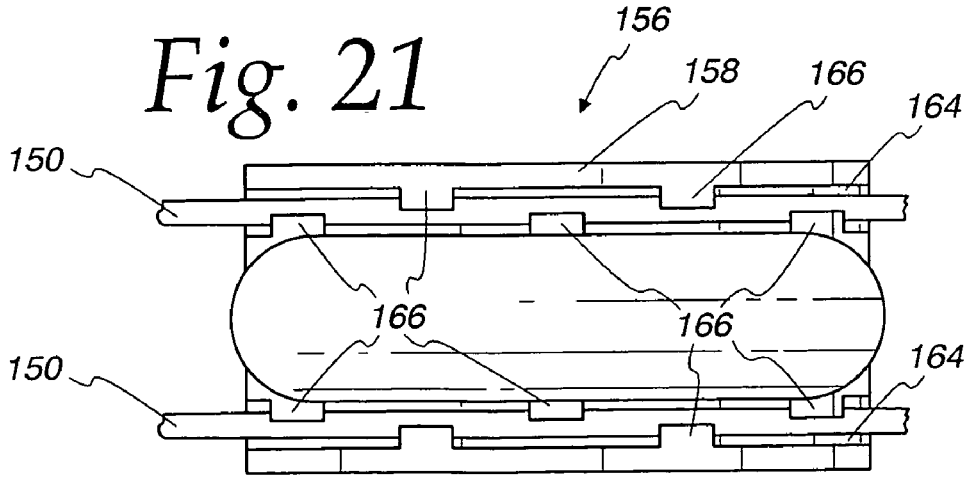
FIG. 21 is a top plan view of the arrangement of FIG. 17.

With reference to FIG. 21, recesses 164 can be provided with optional staggered tabs 166 that holds the tether cords captive, while allowing the tether cords to be threaded into the recesses 64 during the assembly of the sign system. As can be seen in FIGS. 16 and 17, for example, the front wall windows described above with reference to FIGS. 1-12 have been omitted, as being unnecessary since the central tethers 42 are not employed. However, if desired, the windows and remaining construction of the mounting members 66 described above with reference to FIGS. 1-12, can be included in mounting member 156 to accommodate mass production of the mounting member, as may be desired.

Figure 19:
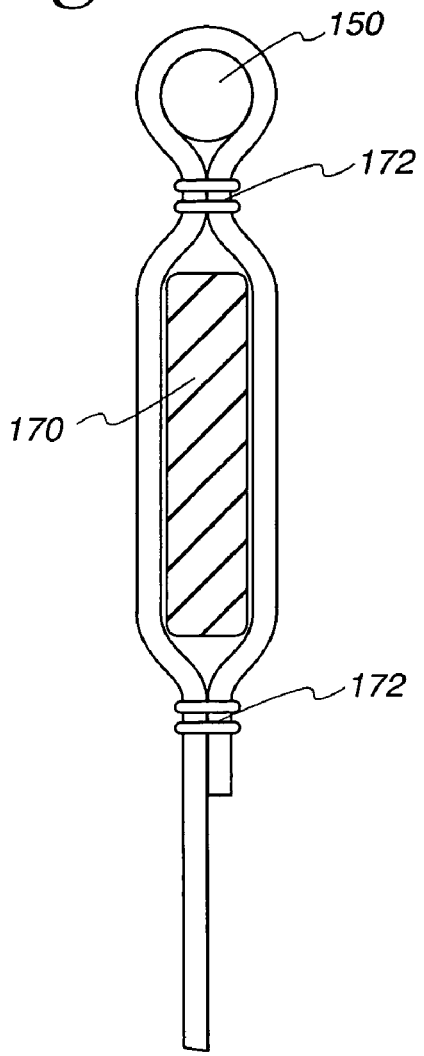
FIG. 19 is a cross-sectional view taken along the line 19-19 of FIG. 16.
Figure 20:
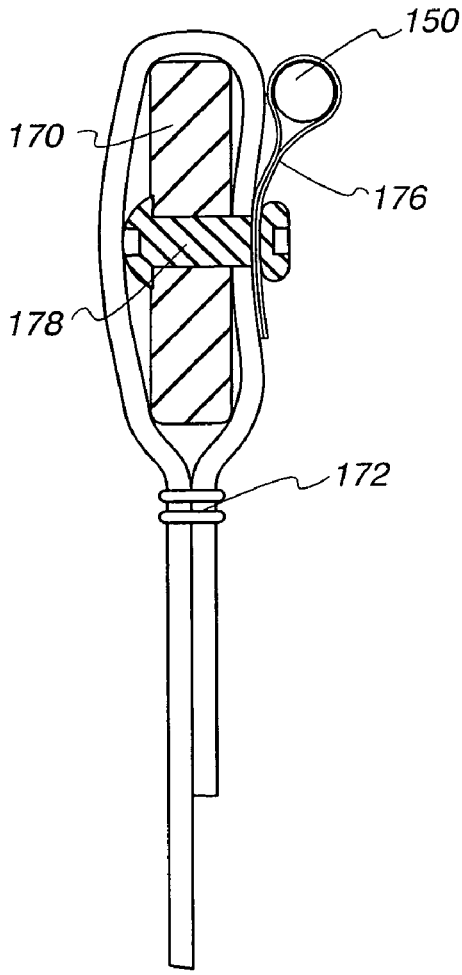
FIG. 20 is a cross-sectional view showing an alternative of the FIG. 19 arrangement.

FIGS. 19 and 20 show alternative methods for securing the ends of tether cord 150 to the flexible web. As shown in FIG. 19, the flexible web is looped about tether cord 150 and a lateral stiffener 170 and secured by stitching or other joinder 172.

In FIG. 20, material from the flexible web is looped over lateral stiffener 170 and secured at 172. A rigid clip made of plastic or metal, for example, is indicated at 176 and provides engagement with tether cord 150, as illustrated. Clip 176 is secured to lateral stiffener 170 by conventional fastening means 178 such as a ribbon or threaded fastener, for example. If desired, two clips 176 can be provided, one adjacent each end of lateral stiffener 170, or a single clip 176 can be arranged so as to co-extend with the lateral stiffener and preferably the width of the flexible web.

Figure 22:
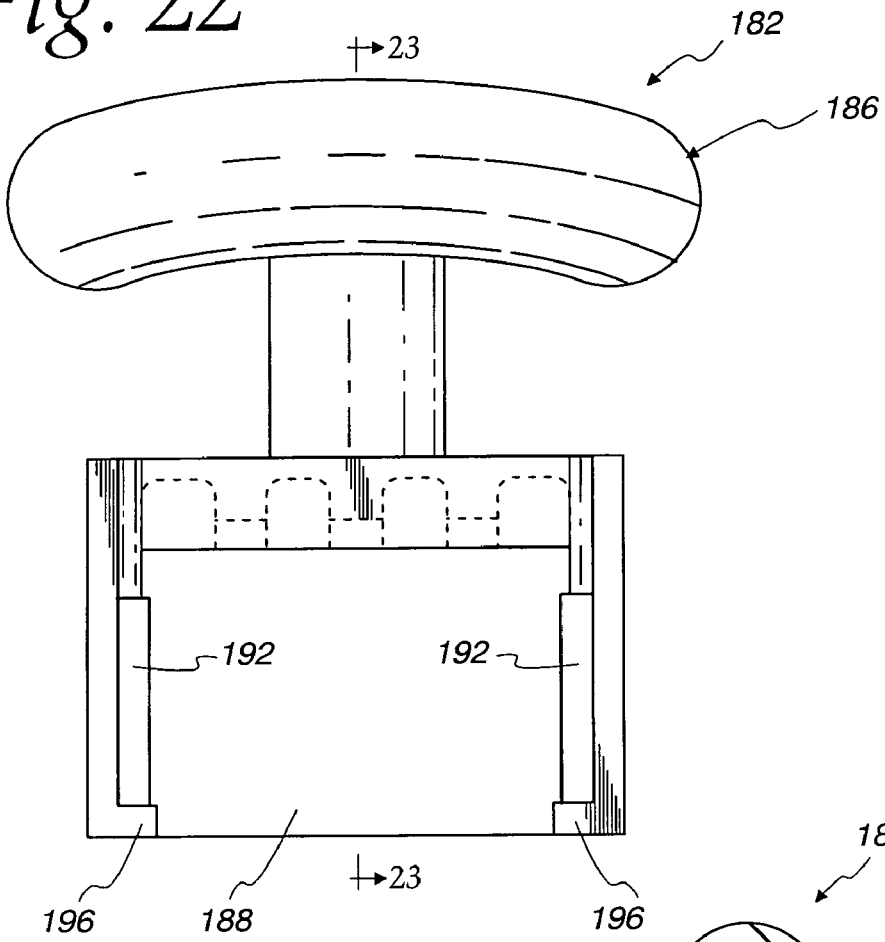
FIG. 22 is a front elevational view of an alternative mounting component.
Figure 23:
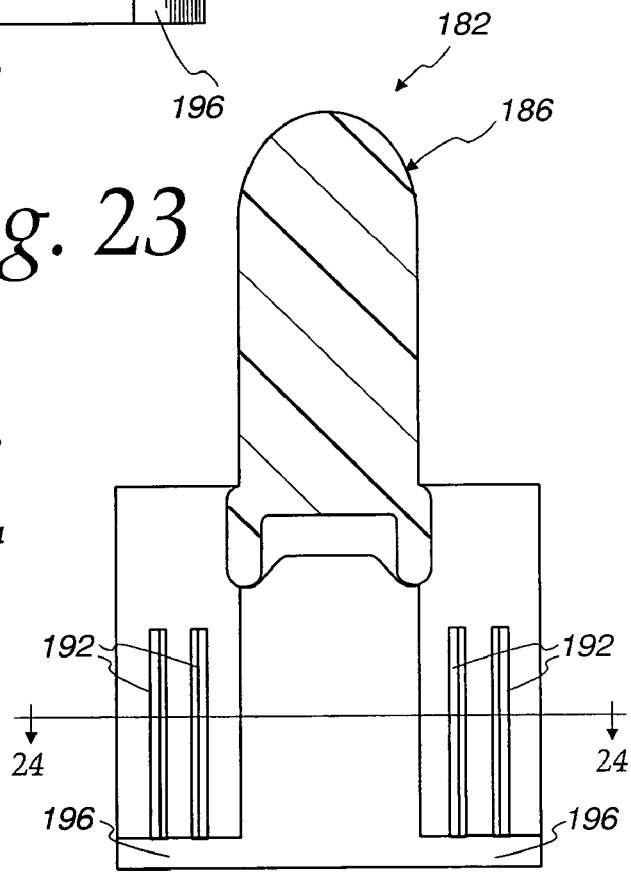
FIG. 23 is a cross-sectional view taken along the line 23-23 of FIG. 22.
Figure 24:
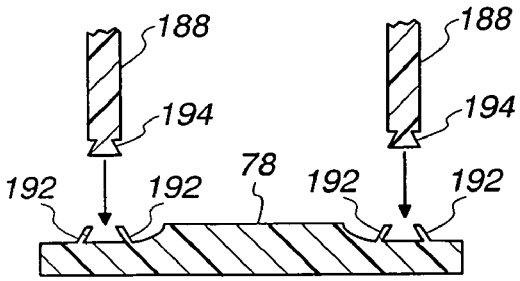
FIG. 24 is a fragmentary cross-sectional view taken along the line 24-24 of FIG. 23.
Figure 25:
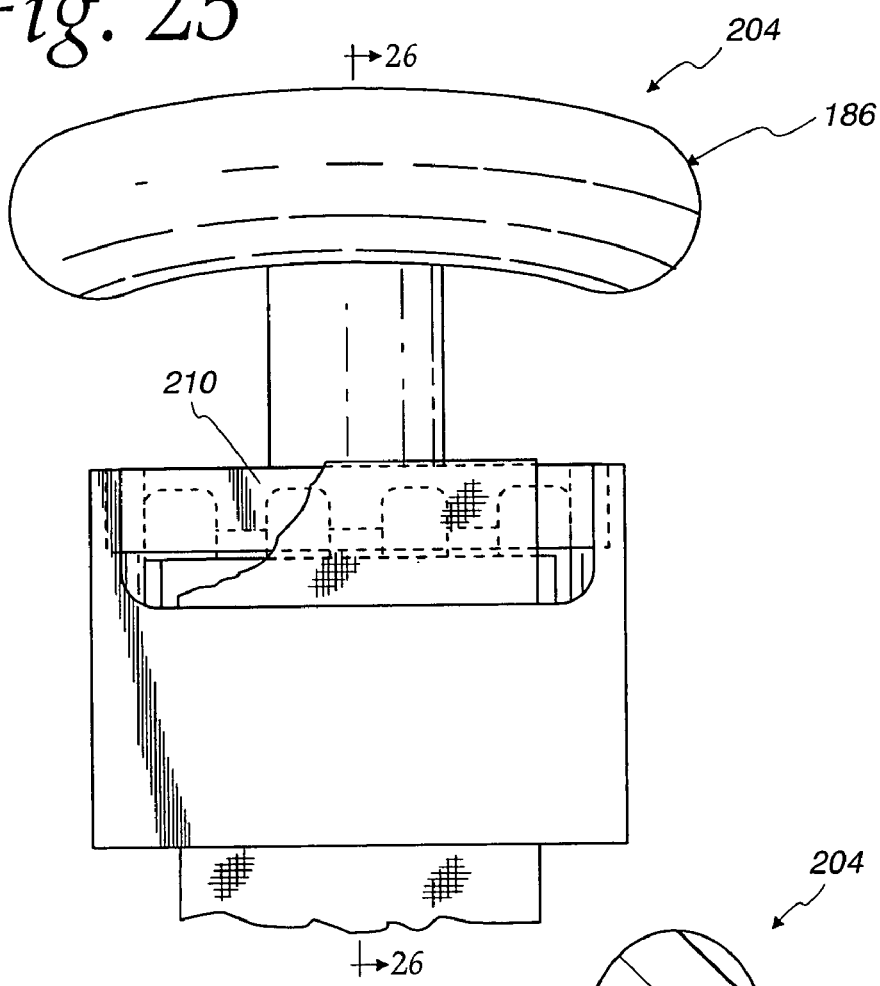
FIG. 25 is a front elevational view of a further alternative embodiment of a mounting component.
Figure 26:
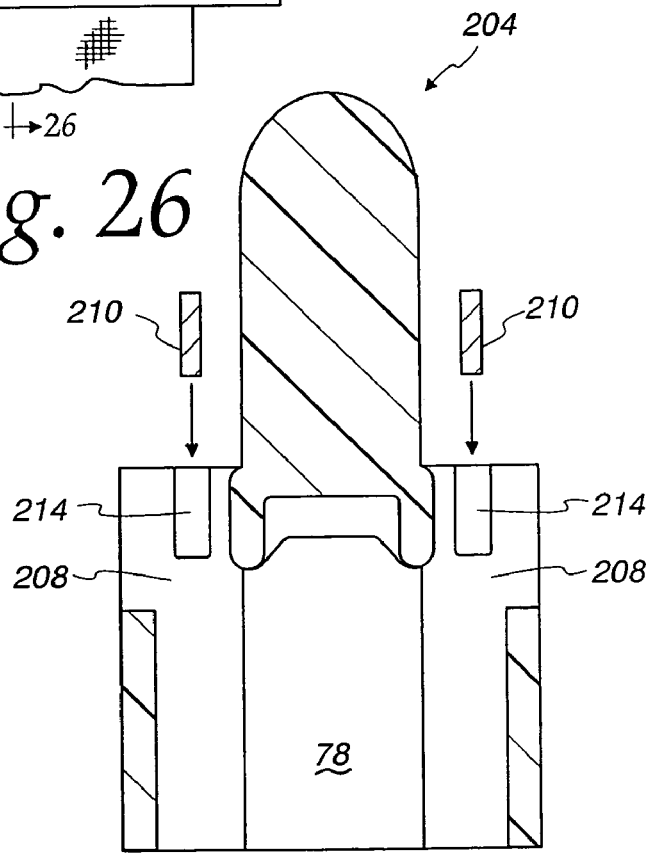
FIG. 26 is a cross-sectional view taken along the line 26-26 of FIG. 25.

Turning now to FIGS. 22-28, two alternative arrangements of mounting members are shown. A first alternative embodiment generally indicated at 182 is shown in FIGS. 22-24. Mounting member 182 is generally identical to mounting member 66 described above, except for being formed from three components, a body 186 and a pair of removable front walls 188. Body 186 includes the features of mounting member 66 as described above, except for the absence of front walls 180. With the arrangement of FIGS. 22-24, mounting member 182 can accommodate a fully formed flexible web, shone for example in FIG. 3. As mentioned above, the mounting member 66 requires the tethers 42 to be looped around the front walls 80 and secured in the manner illustrated, for example, in FIGS. 10-12.

With the mounting member 182, the tethers 42 can be completely formed during fabrication of the flexible web. With reference to FIG. 24, side walls 78 are provided with a pair of dove tail channels formed by channel members 192. Opposed ends of front walls 188 are provided with dove tail configurations 194, as illustrated in FIG. 24. Thus, the front walls 188 can be slid into dove tail channels of side walls 78 from above, and lowered until the front walls contact stop members 196 (see FIGS. 22 and 23), so as to prevent separation of the front walls from body 186 while loads are applied by tethers 42. Thus, by simply inserting front walls 188 in the loops of tethers 42 and sliding the front walls into the position illustrated in FIG. 22, construction of the flexible assembly 120, shown for example in FIG. 13, is completed, allowing all sewing or other construction of the flexible web to be completed off site, as may be desired.

Figure 27:
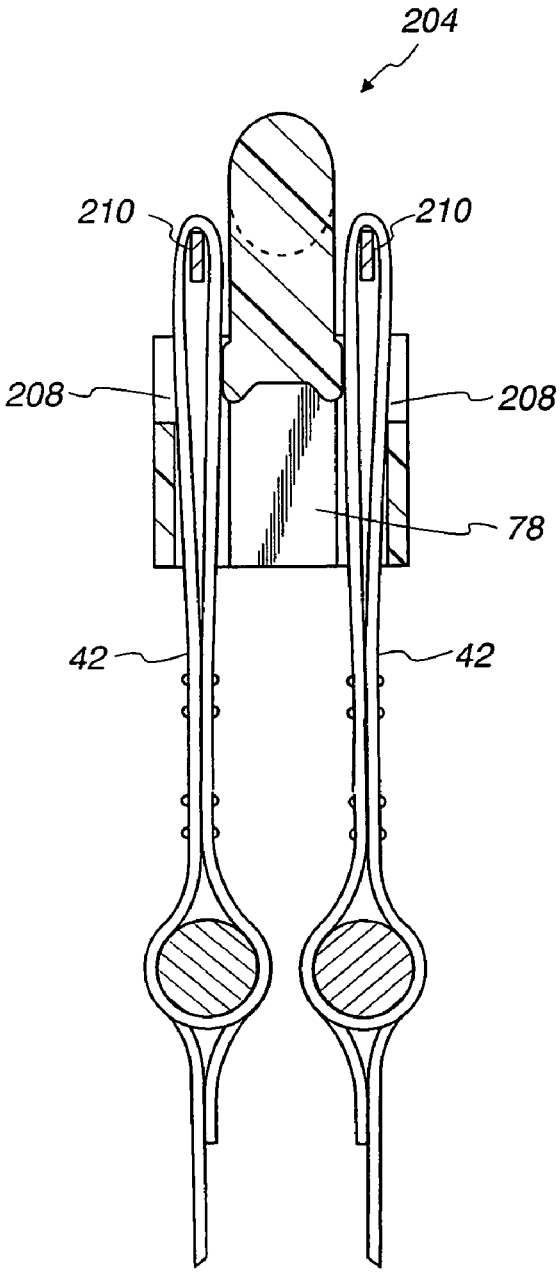
FIG. 27 and FIG. 28 are cross-sectional views similar to those of FIG. 26, but showing stages of assembly of a sign system.
Figure 28:
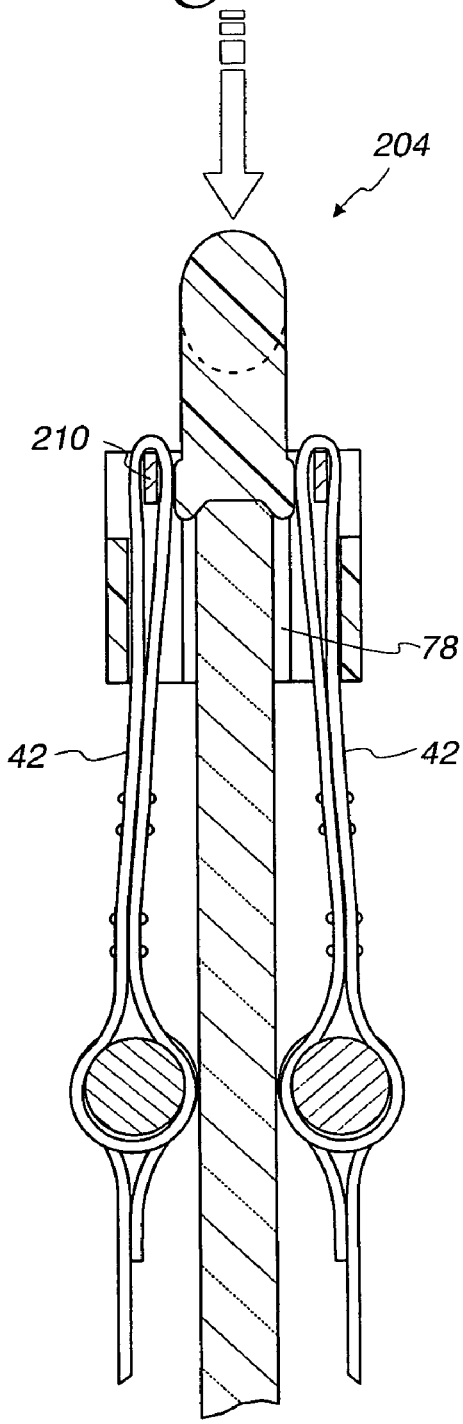

Turning now to FIGS. 25-28, an alternative embodiment of a mounting component is generally indicated at 204. As with the preceding embodiment, mounting member 204 allows the flexible web to be completely constructed prior to assembly of the sign system. Referring to FIG. 27, the looped ends of tether 42 are passed entirely through the interior of the body of mounting member 204. The upper ends of tethers 42 are inserted through windows 208 and a cross member 210. 210 is inserted through the loop. Thereafter, the cross member 210 is seated in pockets 214 formed in side walls 78 and thus held captive within the mounting member. In the preferred embodiment, recesses are formed in side wall 78, similar to recesses 84 (see FIGS. 5-9), to keep the tether from interviewing with the upright member.

Figure 29:
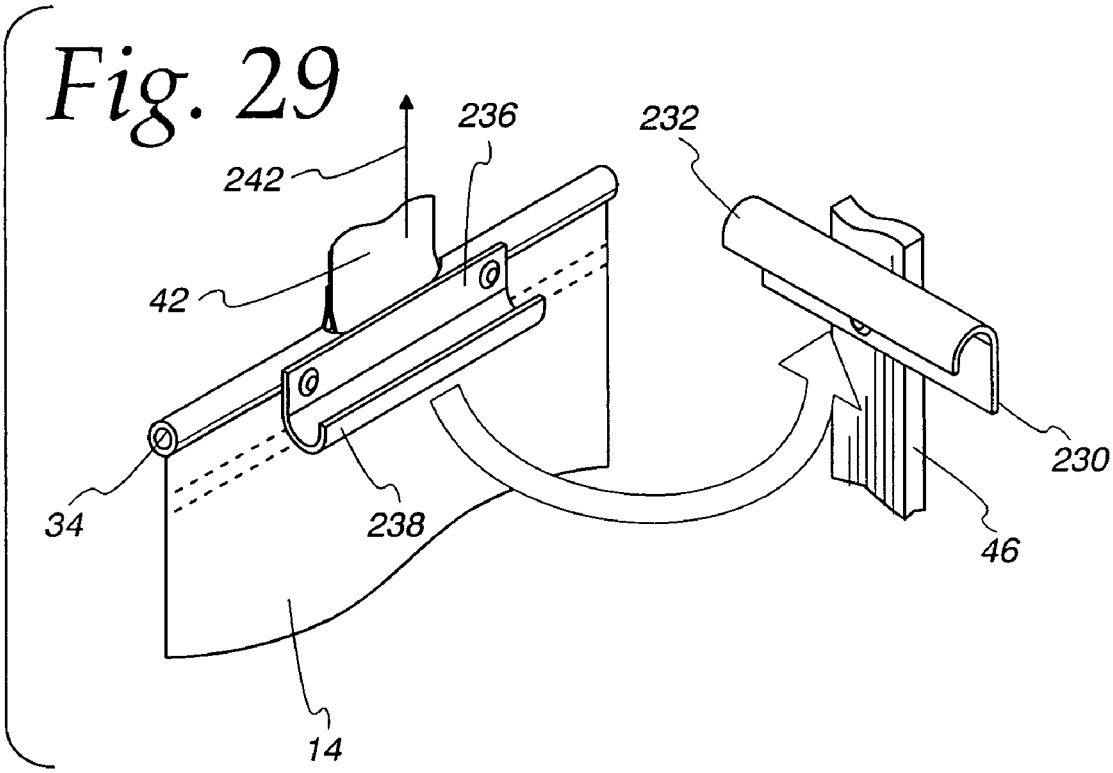
FIG. 29 is a fragmentary perspective view of an alternative assembly for attaching the sign panel.
Figure 30:
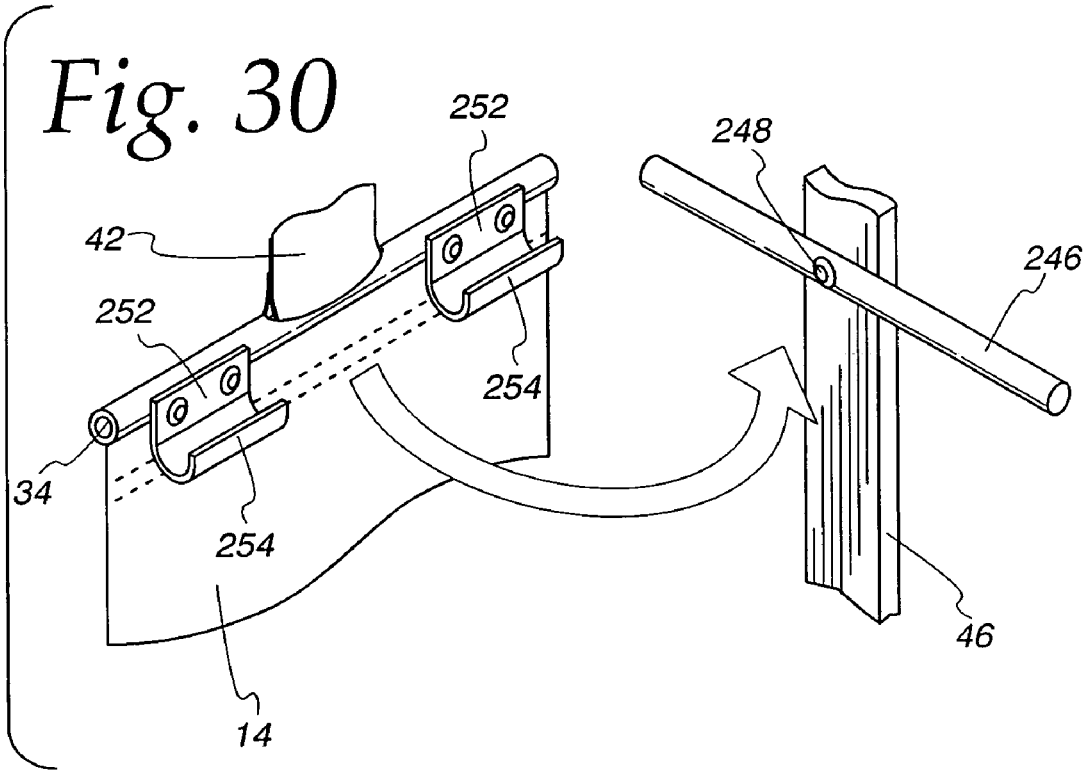
FIG. 30 is a fragmentary perspective view of another alternative assembly for attaching the sign panel.

Referring now to FIGS. 29 and 30, alternative arrangements are show for attaching the sign panel to an upright support, such as the upright member 46 shown in FIG. 2. These alternative arrangements provide support for the upper ends of the sign panel or flexible web 14, to prevent fluttering or other front-to-back movement of the upper end of web 14 when subjected to wind gusts or air turbulence from passing vehicles, causing the upper ends of web 14 to rock about upright member 46.

Referring to FIG. 29, a clip 230 is attached to upright member 46, by a rivet or other conventional fastener. Preferably, clip 230 is free to rotate to a storage position overlying upright member, for compact storage, but could be fixedly mounted, if desired. As shown, clip 230 has a downwardly opening U-shape portion 232 shown in the deployed position in FIG. 29. Clip 230 can be made of virtually any rigid material as may be desired, such as metal or plastic, for example. With reference to FIG. 2, clip 230 is mounted at the upper portion of upright member 46, adjacent laterally extending stiffener 34. A complementary, interengaging clip 236 is attached to stiffener 34 (or, less preferably, the upper end of web 14) using conventional fasteners such as rivets, screws, adhesive or sewn attachment.

As shown, clip 236 has an upwardly opening U-shaped portion 238, dimensioned for interengagement with portion 232 of clip 230. As tether 42 is pulled in the upward direction of arrow 242, clips 230, 236 are brought into mating engagement, one with the other. Owing to the stiffness of the clips 230, 236, rocking of the upper portion of web 14 about upright member 46 is prevented. As shown in FIG. 29, a clip arrangement is provided only for the front panel portion of web 14. For a folded web, such as that illustrated in FIG. 2 for example, a similar pair of interengaging clips could be provided for the second, rear facing panel portion.

Referring now to FIG. 30, and alternative arrangement for stabilizing the upper end of web 14 is shown utilizing a cross member 246, rotatively secured to upright member 46 by a rivet 248 or other conventional fastener. A pivoting connection is preferred, so that the cross member is brought into overlying relationship with upright member 46, for compact storage. Upon deployment of the sign stand assembly, the cross member 246 is rotated to the extended or working position illustrated in FIG. 30. Cross member 246 is preferably made of rigid material, such as wood, plastic or epoxy or other material, reinforced with fiberglass strands, for example.

A pair of clips 252 is attached to the upper end of web 14, preferably by securement to stiffener 34. As indicated in FIG. 30, clips 252 are spaced from one another, on either side of tether 42. Clips 252, made of rigid material, have upwardly opening U-shaped portions 254, dimensioned to receive cross member 246. The cross member 246 is located at the upper end of upright member 46 of FIG. 2, adjacent cross member 34. As the tether is pulled in an upward directions, clip portions 254 are brought into engagement with cross member 246. Owing to the rigidity of cross member 246 and clips 252, their interengagement prevents fluttering of the upper end of web 14, that would otherwise cause it to rock about upright member 46.

Several variations of the arrangement of FIG. 30 are possible. For example, although a cross member 246 of round cross-section is shown, the cross member could have an elongated cross sectional shape, such as the cross member 24, employed at the lower end of the sign stand assembly. As a further variation, the two separate clips 252 could be replaced by a single clip, preferably with a central recess that would allow the clip to straddle upright member 46.

The arrangements of FIGS. 29 and 30 are shown for tethered connections at the upper end of the sign stand assembly, such as that shown in FIGS. 1-4. The same arrangements could, with simple inversion, be employed with an arrangement, such as that shown in FIGS. 14-15, where a tethered connection is provided at the lower end of the sign stand assembly.

As indicated herein, a pair of sign panels are preferably provided as portions of a flexible web which, when folded, causes the sign panels to overly one another. If desired, a single sign panel could be employed, with end portions attached to opposed ends of the same support member, preferably, an upright member. One end of the sign panel would be secured to one end of the support member, and the other end of sign panel would be secured to the other end of the support member. Although both ends of the flexible web are secured to the support member, (an upright mast, for example), it is generally preferred that one of the securements to the support and/or the tethers themselves be made resiliently stretchable, using elastic cords or straps and/or spring bias members such as coil springs. The tethers can be homogenous throughout their length, or can be formed from a serial array of different components. Some of the components could be rigid and some of the components could be resilient, for example.

The foregoing description and the accompanying drawings are illustrative of the present invention. Still other variations and arrangements of parts are possible without departing from the spirit and scope of this invention.

What is claimed is:

1. A sign system, comprising:

a flexible sign panel having a middle section and opposed free ends;

a frame including first and second frame members pivotally joined together, each frame member having opposed free ends;

a mounting member defining a socket for receiving a first end of the first frame member;

at least one biasing tether connecting the mounting member to at least one free end of the sign panel; and the frame members, the sign panel, the mounting member and the biasing tether cooperating such that, with the second frame member engaging the middle section of the sign panel, the free ends of the sign panel are supported adjacent the first end of the first frame member, and the second frame member and the middle section of the sign panel are supported by the first frame member at a point spaced from the first end of the first frame member.

2. The sign system according to claim 1 further comprising a support base engaging the second end of the first frame member.

3. The sign system according to claim 1 wherein the biasing tether comprises a pair of bias cords.

4. The sign system according to claim 1 wherein the biasing tether comprises a cord engaging a center portion of the sign panel free end.

5. The sign system according to claim 1 wherein the biasing tether comprises a cord having opposed ends extending from the free end of sign panel, with a central portion of the cord engaging the mounting member.

6. The sign system according to claim 1 wherein the middle section of the sign panel supported by the second frame member is located at approximately midway between ends of the sign panel, with opposed sign panel portions generally coextensive with one another.

7. The sign system according to claim 1 wherein the free ends of the sign panel are positioned adjacent one another.

8. The sign system according to claim 1 further comprising stiffeners at the free ends of the sign panel.

9. A sign system, comprising:

a flexible sign panel having a middle section and opposed free ends;

a frame including first and second frame members pivotally joined together, each frame member having opposed free ends;

a mounting member defining a socket for receiving a first end of the first frame member;

at least one biasing tether connecting the mounting member to at least one free end of the sign panel;

the frame members, the sign panel, the mounting member and the biasing tether cooperating such that, with the second frame member engaging the middle section of the sign panel, the free ends of the sign panel are supported adjacent the first end of the first frame member, and the second frame member and the middle section of the sign panel are supported by the first frame member at a point spaced from the first end of the first frame member; and a support base engaging the second end of the first frame member.

10. The sign system according to claim 9 wherein the biasing tether comprises a cord engaging a center portion of the sign panel free end.

11. The sign system according to claim 9 wherein the middle section of the sign panel supported by the second frame member is located at approximately midway between ends of the sign panel, with opposed sign panel portions generally coextensive with one another.

12. The sign system according to claim 9 wherein the free ends of the sign panel are positioned adjacent one another.

13. The sign system according to claim 9 further comprising stiffeners at the free ends of the sign panel.

14. A sign system, comprising:

a flexible sign panel having a middle section and opposed free ends, with stiffeners at the free ends;

a frame including first and second frame members pivotally joined together, each frame member having opposed free ends;

the middle section of the sign panel being supported by the second frame member and located at approximately midway between the ends of the sign panel, with opposed sign panel portions generally coextensive with one another, and with the free ends of the sign panel positioned adjacent one another a mounting member defining a socket for receiving a first end of the first frame member;

at least one biasing tether connecting the mounting member to at least one free end of the sign panel; and the frame members, the sign panel, the mounting member and the biasing tether cooperating such that, with the second frame member engaging the middle section of the sign panel, the free ends of the sign panel are supported adjacent the first end of the first frame member, and the second frame member and the middle section of the sign panel are supported by the first frame member at a point spaced from the first end of the first frame member.

15. The sign system according to claim 14 further comprising a support base engaging the second end of the first frame member.

16. The sign system according to claim 14 wherein the biasing tether comprises a pair of bias cords.

17. The sign system according to claim 14 wherein the biasing tether comprises a cord engaging a center portion of the sign panel free end.

18. A sign system, comprising:

a flexible sign panel having a middle section and opposed free ends;

a frame including upright and cross frame members pivotally joined together, each frame member having opposed free ends;

at least one engagement member on the upright support member;

at least one biasing tether connecting the at least one engagement member to the sign panel; and the frame members, the sign panel, the at least one engagement member and the biasing tether cooperating such that, with the cross frame member engaging the middle section of the sign panel, the free ends of the sign panel are supported adjacent the second end of the upright frame member, and the cross frame member and the middle section of the sign panel are supported by the cross frame member at a point spaced from the first end of the upright frame member.

19. The sign system according to claim 18 wherein the biasing tether comprises a pair of bias cords.

20. The sign system according to claim 18 wherein the biasing tether comprises a cord engaging a center portion of the sign panel free end.

21. The sign system according to claim 18 wherein the biasing tether comprises a cord having opposed ends extending from the free end of sign panel, with a central portion of the cord engaging the mounting member.

22. A sign panel kit, comprising:

a flexible sign panel having a middle section and opposed free ends;

a frame including first and second frame members pivotally joined together, each frame member having opposed free ends;

a mounting member defining a socket for receiving a first end of the first frame member;

at least one biasing tether connecting the mounting member to at least one free end of the sign panel;

the frame members, the sign panel, the mounting member and the biasing tether cooperating such that, with the second frame member engaging the middle section of the sign panel, the free ends of the sign panel are supported adjacent the first end of the first frame member, and the second frame member and the middle section of the sign panel are supported by the first frame member at a point spaced from the first end of the first frame member; and a container for carrying the sign panel, mounting member, tether and base.

23. The sign system according to claim 22 further comprising a support base engaging the second end of the first frame member.

24. The sign system according to claim 22 wherein the biasing tether comprises a pair of bias cords.

25. The sign system according to claim 22 wherein the biasing tether comprises a cord engaging a center portion of the sign panel free end.

* * * * *

UNITED STATES PATENT AND TRADEMARK OFFICE

CERTIFICATE OF CORRECTION

PATENT NO. : 7,849,618 B2
APPLICATION NO. : 12/009772
DATED : December 14, 2010
INVENTOR(S) : Dicke It is certified that error appears in the above-identified patent and that said Letters Patent is hereby corrected as shown below:

In the Specification:

Column 8, line 5, “shone for example” should be --shown for example --
Column 8, line 40, “are show for attaching” should be --are shown for attaching--
Column 9, line 6, “and alternative arrangement” should be --an alternative arrangement--
Column 9, line 25, “an upward directions,” should be --an upward direction,--

In the Claims:

Claim 6, Column 10, line 35, “is located at approximately” should be --is located approximately--
Claim 14, Column 11, line 19, a “;” should be placed after “another” at the end of the paragraph Signed and Sealed this
Seventh Day of June, 2011

David J. Kappos

David J. Kappos
*Director of the United States Patent and Trademark Office*